US010662712B2

(12) United States Patent
Copold et al.

(10) Patent No.: US 10,662,712 B2
(45) Date of Patent: May 26, 2020

(54) MODULAR ELECTRO-MECHANICAL ASSEMBLY FOR DOWNHOLE DEVICE

(71) Applicant: Schlumberger Technology Corporation, Sugar Land, TX (US)

(72) Inventors: Derek Copold, Sugar Land, TX (US); Pierre Olivier Gourmelon, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 255 days.

(21) Appl. No.: 15/898,675

(22) Filed: Feb. 19, 2018

(65) Prior Publication Data

US 2019/0257154 A1 Aug. 22, 2019

(51) Int. Cl.

| | |
|---|---|
| ***E21B 7/06*** | (2006.01) |
| ***E21B 47/18*** | (2012.01) |
| ***E21B 15/04*** | (2006.01) |

(52) U.S. Cl.

CPC ..... *E21B 7/067* (2013.01); *E21B 7/068* (2013.01); *E21B 15/045* (2013.01); *E21B 47/185* (2013.01)

(58) Field of Classification Search

CPC ..... E21B 7/067; E21B 7/068; E21B 15/045; E21B 17/06; E21B 31/00; E21B 31/14; E21B 31/18; E21B 31/20

See application file for complete search history.

(56) References Cited

U.S. PATENT DOCUMENTS

| | | | | |
|---|---|---|---|---|
| 3,396,795 | A * | 8/1968 | Venghiattis | E21B 29/00 166/55.7 |
| 3,446,284 | A * | 5/1969 | Dyer | E21B 19/20 173/164 |
| 4,632,193 | A * | 12/1986 | Geczy | E21B 4/00 166/237 |
| 4,856,582 | A | 8/1989 | Smith et al. | |
| 5,984,009 | A | 11/1999 | DiFoggio | |
| 2007/0181305 | A1 | 8/2007 | McGavern et al. | |
| 2013/0014934 | A1 | 1/2013 | Macrae et al. | |
| 2015/0275643 | A1* | 10/2015 | Holder | E21B 43/263 166/63 |

FOREIGN PATENT DOCUMENTS

| | | |
|---|---|---|
| WO | 9838410 A1 | 9/1998 |

OTHER PUBLICATIONS

International Search Report and Written Opinion issued in the related PCT Application PCT/US2019/018449, dated Jun. 12, 2019 (9 pages).

* cited by examiner

*Primary Examiner* — David Carroll
(74) *Attorney, Agent, or Firm* — Eileen Pape

(57) ABSTRACT

A motorized release device for a downhole device includes one or more dogs disposed within a guide of the downhole device. The one or more dogs may move radially within the guide relative to a central axis of the motorized release device, such that the one or more dogs may move between an engaged position and a disengaged position. The motorized release device also includes a cam that is rotatable about the central axis, such that the cam may move between a locked position and an unlocked position. The cam may block the one or more dogs from moving to the disengaged position while the cam is in the locked position. The motorized release device may also include an electronics board. The electronics board may attach to a motor that rotates the cam between the locked position and the unlocked position.

20 Claims, 16 Drawing Sheets

MODULAR ELECTRO-MECHANICAL ASSEMBLY FOR DOWNHOLE DEVICE

BACKGROUND

This disclosure relates to a system and method for modular assembly of a motorized release device of a downhole device.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Producing hydrocarbons from a wellbore drilled into a geological formation is a remarkably complex endeavor. In many cases, decisions involved in hydrocarbon exploration and production may be informed by measurements from downhole well-logging tools that are conveyed deep into the wellbore. The measurements may be used to infer properties and characteristics of the geological formation surrounding the wellbore. Thus, when a wellbore is investigated to determine the physical condition of a fluid within the wellbore, a gas within the wellbore, or the wellbore itself, it may be desirable to place downhole device with associated measurement tools and/or sensors within the wellbore.

A cable may be used to raise or lower the downhole device within a casing of the wellbore. In certain cases, an obstruction within the casing may block the downhole device from moving along certain portions of the casing. For example, the geological formation may constrict a portion of the casing (e.g., due to external pressure applied to the casing) while the downhole device is disposed within the wellbore, such that the cable is unable to move the downhole device through the constriction. In some cases, the cable may break when attempting to force the downhole device through the constriction. Unfortunately, recovering the downhole device is difficult while the broken cable is disposed within the wellbore. Additionally, replacing the broken cable may be expensive and time consuming.

In some cases, the downhole device includes an array of mechanical components that operate in conjunction with electro-mechanical or electric components. The electrical components of the downhole device may be difficult and time consuming to replace. Accordingly, the downhole device may be inoperable for a substantial period of time while a service technician inspects or replaces the electrical components of the downhole device.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one example, a motorized release device for a downhole device includes one or more dogs disposed within a guide of the downhole device. The one or more dogs may move radially within the guide relative to a central axis of the motorized release device, such that the one or more dogs may move between an engaged position and a disengaged position. The motorized release device also includes a cam that is rotatable about the central axis, such that the cam may move between a locked position and an unlocked position. The cam may block the one or more dogs from moving to the disengaged position while the cam is in the locked position. The motorized release device further includes an electronics board. The electronics board may include a motor that rotates the cam between the locked position and the unlocked position.

In another example, a method includes rotating a cam gear of a motorized release device via a motor. The motorized release device may be disposed within a housing of a downhole device. The cam gear may couple to a cam, which may rotate between a locked position and an unlocked position. The method also includes neutralizing a pressure differential between an interior region of the motorized release device and an ambient environment via a pressure relief valve. The pressure relief valve may include a sealing pin that is moved between an open position and a closed position. The sealing pin may enable a fluid to flow through the pressure relief valve when the sealing pin is in the open position and block the fluid from flowing through the pressure relief valve when sealing pin is in the closed position. The method further includes moving one or more dogs via a rope socket assembly. The one or more dogs may move between an engaged position and a disengaged position. The one or more dogs may couple the rope socket assembly to the downhole device when the one or more dogs are in the engaged position. The rope socket assembly may decouple from the downhole device when the one or more dogs are in the disengaged position.

In another example, a housing of a motorized release device may include a cam disposed concentrically about an axial centerline of the housing. The cam may rotate about the axial centerline and move between a locked position and an unlocked position. A transmission shaft may be rotatably coupled to a cam gear of the cam and rotate the cam gear between the locked position and the unlocked position. The housing may include one or more dogs disposed within a guide of the housing that move radially relative to the axial centerline between an engaged position and a disengaged position. The one or more dogs may be disposed in the engaged position when the cam is in the locked position. The housing also includes and electronics boards that includes a plurality of couplings, which enable the electronics board to be removably coupled to the housing. The plurality of coupling may include a resistance temperature detector coupling that fluidly couples a resistance temperature detector to an ambient environment of the downhole device. The plurality of couplings may also include a wire coupling that couples one or more electrical connections between the electronics board and the housing. The plurality of couplings may further include a drive shaft coupling that couples the transmission shaft to a motor disposed on the electronics board.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
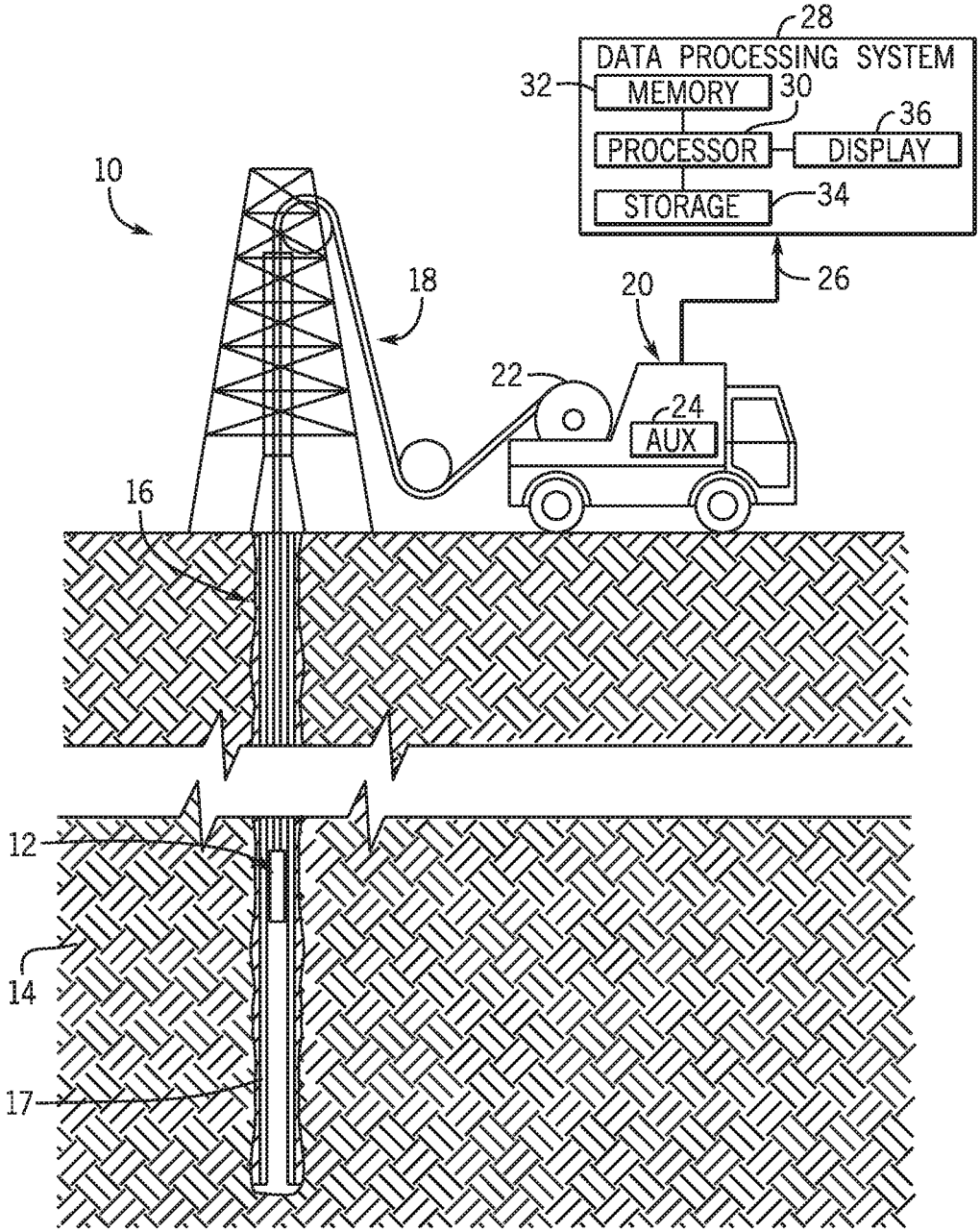
FIG. 1 is a schematic diagram of a wellbore logging system and downhole device that may obtain data measurements along the length of the wellbore, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Downhole devices may be conveyed through a wellbore using a cable that is spooled or unspooled on a drum. In some cases, a casing may be disposed within the wellbore, such that the casing may shield the downhole device from a surrounding geological formation. The downhole device may be used to investigate physical characteristics of fluids or gases within the casing and/or the wellbore. In certain cases, the downhole device may become stuck within the casing due to an obstruction disposed within the casing. For example, external pressure from the geological formation may constrict a portion of the casing, such that the downhole device is blocked from moving through the constricted portion of the casing.

In order to facilitate retrieval of the downhole device in such cases, a motorized release device may be integrated within the downhole device and used to decouple the downhole device from the cable. For example, if the downhole device is stuck within the casing, the motorized release device may enable the cable to detach from the downhole device, such that the cable may be retrieved from the wellbore. The downhole device may be retrieved subsequently from the wellbore using a designated recovery tool.

The downhole device may include an array of mechanical components (e.g., the motorized release devices) and an array of electro-mechanical components and/or electrical components (e.g., a controller used to operate the motorized release device, temperature sensors, position sensors). In some cases, the electro-mechanical and/or electrical components may be difficult to separate from the mechanical components. Accordingly, it may be time consuming for an operator (e.g., a service technician) to maintain and/or replace certain components of the downhole device. For example, the operator may remove a substantial portion of the mechanical components in order to access the electro-mechanical and/or electrical components of the downhole device. The systems and methods of this disclosure allow for rapid removal and/or replacement of the electro-mechanical and electrical components of the downhole device.

With this in mind, FIG. 1 illustrates a well-logging system 10 that may employ the systems and methods of this disclosure. The well-logging system 10 may be used to convey a downhole device 12 or a dummy weight through a geological formation 14 via a wellbore 16. In some embodiments, a casing 17 may be disposed within the wellbore 16, such that the downhole device 12 may traverse the wellbore 16 within the casing 17. The downhole device 12 may be conveyed on a cable 18 via a logging winch system 20. Although the logging winch system 20 is schematically shown in FIG. 1 as a mobile logging winch system carried by a truck, the logging winch system 20 may be substantially fixed (e.g., a long-term installation that is substantially permanent or modular). Any cable 18 suitable for well logging may be used. The cable 18 may be spooled and unspooled on a drum 22 and an auxiliary power source 24 may provide energy to the logging winch system 20 and/or the downhole device 12.

The downhole device 12 may provide logging measurements 26 to a data processing system 28 via any suitable telemetry (e.g., via electrical or optical signals pulsed through the geological formation 14 or via mud pulse telemetry). The data processing system 28 may process the logging measurements. The logging measurements 26 may indicate certain properties of the wellbore 16 (e.g., pressure, temperature, strain, vibration, or other) that might otherwise be indiscernible by a human operator.

To this end, the data processing system 28 thus may be any electronic data processing system that can be used to carry out the systems and methods of this disclosure. For example, the data processing system 28 may include a processor 30, which may execute instructions stored in memory 32 and/or storage 34. As such, the memory 32 and/or the storage 34 of the data processing system 28 may be any suitable article of manufacture that can store the instructions. The memory 32 and/or the storage 34 may be ROM memory, random-access memory (RAM), flash memory, an optical storage medium, or a hard disk drive, to name a few examples. A display 36, which may be any suitable electronic display, may provide a visualization, a well log, or other indication of properties in the geological formation 14 or the wellbore 16 using the logging measurements 26.

Figure 2:
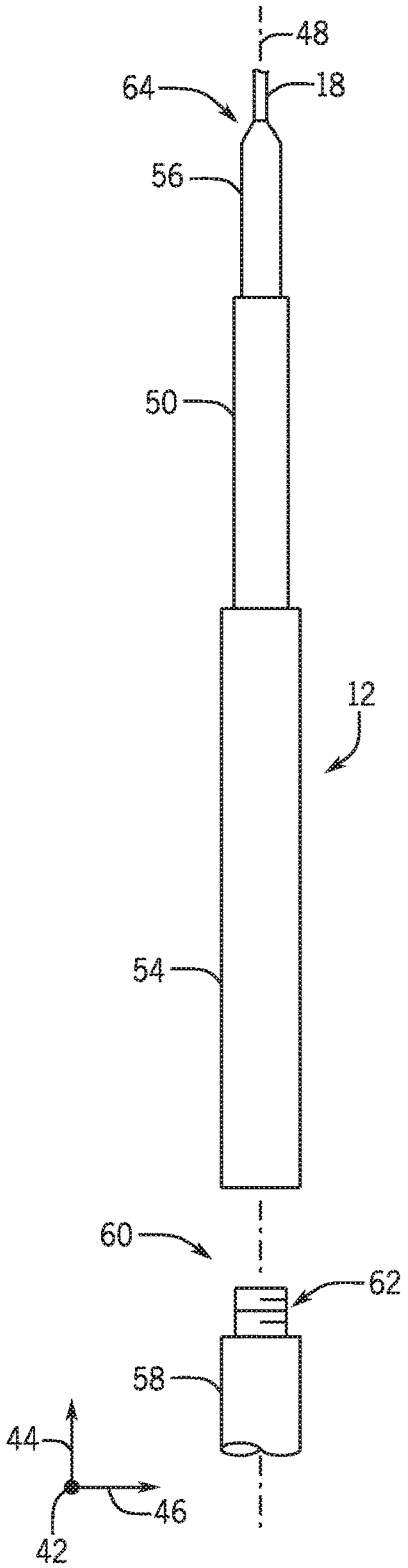
FIG. 2 is a front view of the downhole device of FIG. 1 and a rope socket assembly, in accordance with an embodiment of the present disclosure.

FIG. 2 is a front view of the downhole device 12. To facilitate discussion, the downhole device 12 and its components may be described with reference to a longitudinal axis or direction 42, a vertical axis or direction 44, and a lateral axis or direction 46. An axial centerline 48 of the downhole device 12 extends parallel to the vertical direction 44. As described in greater detail herein, the downhole device 12 may include an upper housing 50 and an electronics housing 54, which are removably coupled to a rope socket assembly 56. In some embodiments, the downhole device 12 may include additional or fewer components. For example, an auxiliary tool 58 may couple to a lower end portion 60 of the downhole device 12 via threads 62, such that the auxiliary tool 58 may be used to provide additional logging measurements 26 to the data processing system 28. A lower end portion 64 of the cable 18 may fixedly couple to the rope socket assembly 56 via crimping (e.g., a compression fit), fasteners (e.g., bolts, clamps), adhesives (e.g., welding), or any other suitable method. Accordingly, the rope socket assembly 56 may enable the downhole device 12 to be conveyed along the wellbore 16 by spooling or unspooling the cable 18 on the drum 22.

Figure 3:
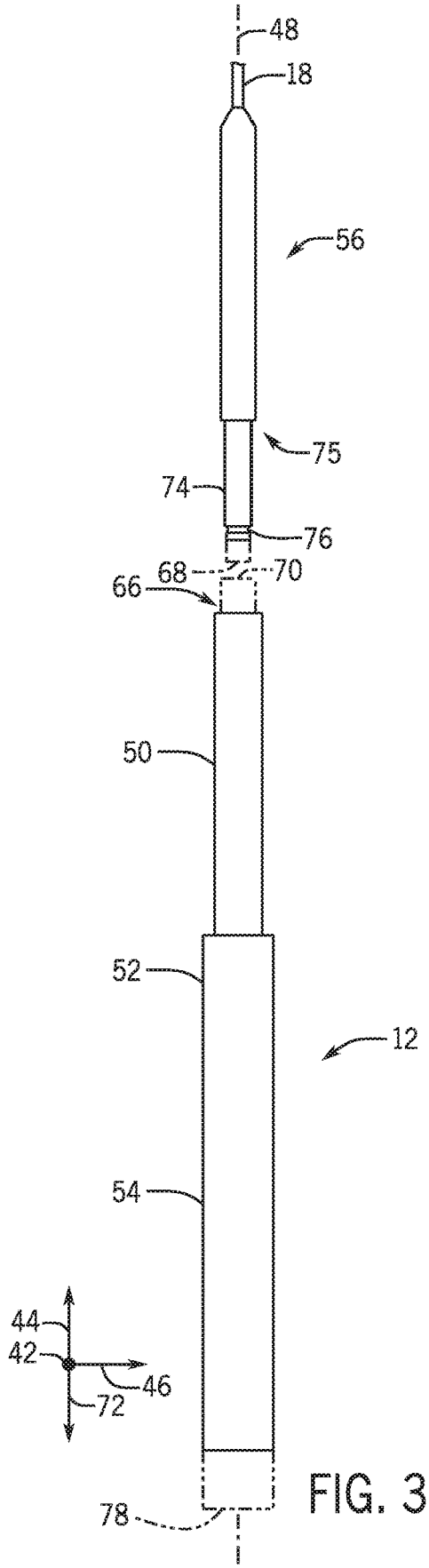
FIG. 3 is a front view of the downhole device of FIG. 2, in which the downhole device is decoupled from the rope socket assembly, in accordance with an embodiment of the present disclosure.

FIG. 3 illustrates a front view of the downhole device 12 in which the rope socket assembly 56 is decoupled from the downhole device 12. In some embodiments, the downhole device 12 may include an axial chamber 66 (e.g., a cylindrical interior region) that is disposed concentrically about the axial centerline 48. An outer diameter 68 of the rope socket assembly 56 may be less than an inner diameter 70 of the axial chamber 66. Accordingly, the rope socket assembly 56 may slide into (e.g., along a direction 72) or out of (e.g., along direction 44) the downhole device 12. The rope socket assembly 56 may include a strain gauge 74 that is coupled to a lower end portion 75 of the rope socket assembly 56. As described in greater detail herein, the downhole device 12 may include an integrated motorized release device, which may removably couple the strain gauge 74, and thus the rope socket assembly 56, to the downhole device 12. For example, the motorized release device may engage with a connection area 76 of the strain gauge 74, thus enabling the rope socket assembly 56 and the downhole device 12 to be conveyed through the wellbore 16 as a single unit (as shown in FIG. 1). While the motorized release device is described as coupling to the strain gauge 74 in the embodiments disclosed herein, it should be noted that the motorized release device may couple to any suitable adapter in lieu of the strain gauge 74. For example, a steel adapter may couple to the lower end portion 75 of the rope socket assembly 56 instead of the strain gauge 74. Accordingly, the motorized release device may couple the rope socket assembly 56 to the downhole device 12 by engaging with a connection area of the steel adapter.

As discussed above, the downhole device 12 may become stuck (e.g., substantially restricted from motion) within the casing 17 during certain operational conditions of the well-logging system 10. For example, external pressure from the geological formation 14 may constrict a portion of the casing 17 while the downhole device 12 is disposed within the wellbore 16, such that the cable 18 is unable to retrieve the downhole device 12 to the surface of the wellbore 16. In some embodiments, an operator (e.g., a human operator, a processor) may determine if the downhole device 12 is stuck by measuring a tension on the cable 18. For example, the tension on the cable 18 may increase substantially if the downhole device 12 is restricted of movement while the drum 22 spools the cable 18. Because the motorized release device couples the downhole device 12 to the rope socket assembly 56 by engaging with the strain gauge 74, the strain gauge 74 may be used to measure the tension on the cable 18. In other embodiments, the tension on the cable 18 may be measured via sensors disposed near the surface of the wellbore 16. For example, a torque required to spool the drum 22 may be measured and analyzed to determine whether the downhole device 12 may be stuck within the wellbore 16.

The motorized release device may be used to decouple the rope socket assembly 56 from the downhole device 12 if the drum 22 is unable to retrieve the downhole device 12 from the wellbore 16. In certain embodiments, the motorized release device may disengage with the connection area 76 of the strain gauge 74, such the cable 18 and rope socket assembly 56 may move independently of the downhole device 12. Accordingly, the cable 18 and the rope socket assembly 56 may be retrieved from the wellbore 16. In some embodiments, the outer diameter 68 of the rope socket assembly 56 may be substantially less than an outer diameter 78 of the downhole device 12. As such, the rope socket assembly 56 may traverse a restriction within the casing 17 even if the downhole device 12 is disabled from traversing the restriction.

In some embodiments, a recovery tool may descend into the wellbore 16 after the cable 18 and rope socket assembly 56 have been retrieved, such that the recovery tool may release the downhole device 12 from the obstruction within the wellbore 16. The recovery tool may be coupled to a high tensile-strength recovery cable, which may be capable of sustaining more tension, and thus applying more force, than the cable 18 used to direct the downhole device 12 through the wellbore 16. Accordingly, the recovery tool may apply a force that is sufficient to release the downhole device 12 from the obstruction, such that the downhole device 12 may be retrieved from the wellbore 16.

Figure 4:
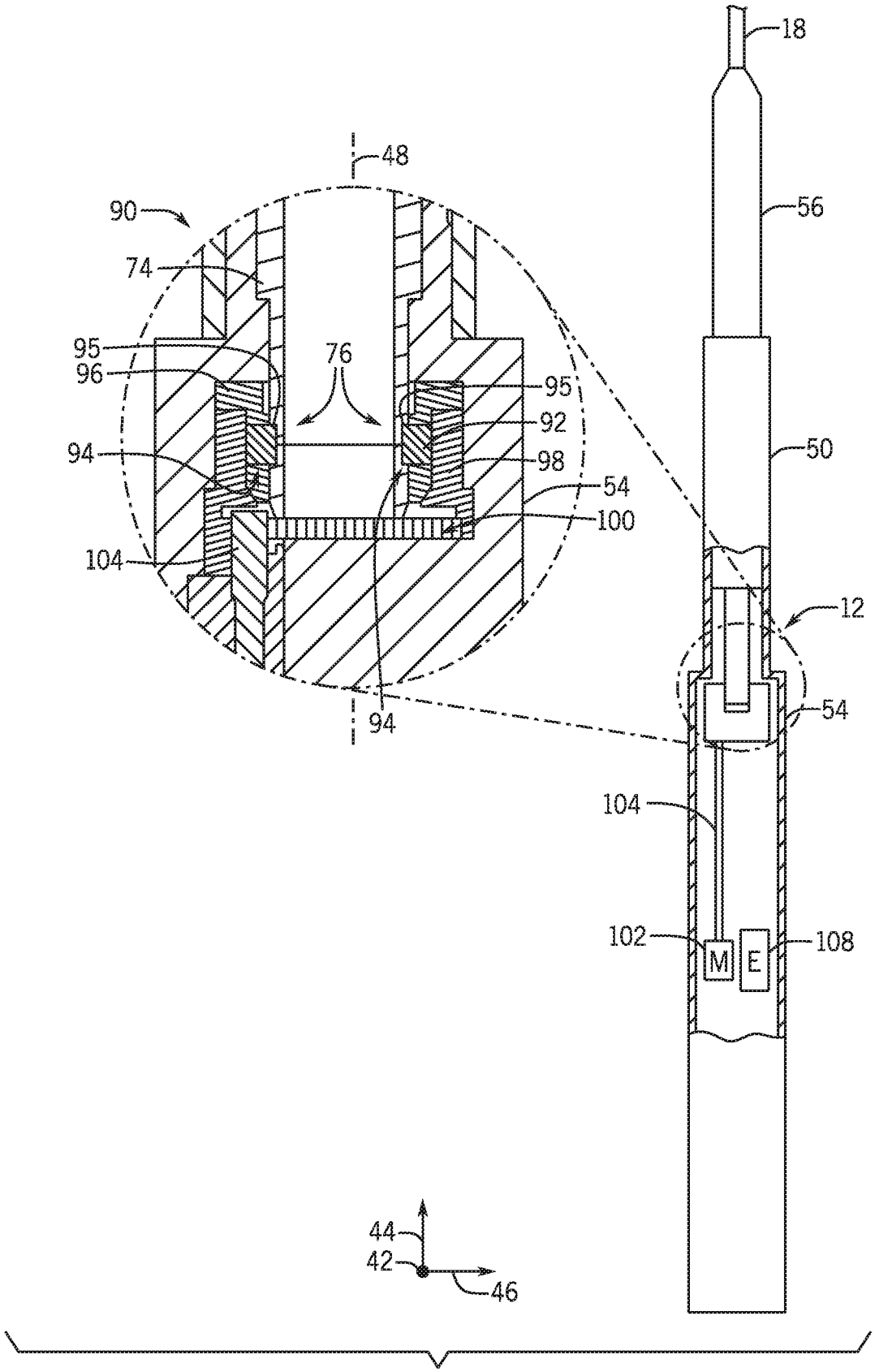
FIG. 4 is a cross-sectional view of the downhole device of FIG. 2 that includes a motorized release device, in accordance with an embodiment of the present disclosure.

With the forgoing in mind, FIG. 4 illustrates a cross-sectional view of the motorized release device 90. As discussed above, the motorized release device 90 may be integrated within the downhole device 12 and couple the downhole device 12 to the strain gauge 74 of the rope socket assembly 56. The motorized release device 90 may include one or more dogs 92 that engage with the connection area 76 of the strain gauge 74. As described in greater detail herein, the dogs 92 may slide radially about the axial centerline 48, such that the dogs 92 may engage or disengage with the connection area 76. In the illustrated embodiment, the dogs 92 are in an engaged position 94, in which the dogs 92 are moved radially inward (e.g., toward the axial centerline 48). Accordingly, an outer profile 95 of the dogs 92 engages with the connection area 76 of the strain gauge 74, such that the strain gauge 74 is blocked from axial movement (e.g., movement along the vertical direction 44) relative to the downhole device 12. Conversely, the dogs 92 be moved to a disengaged position by moving radially outward, such that the dogs 92 may disengage with the connection area 76 and enable the strain gauge 74 to move along the vertical direction 44 relative to the downhole device 12.

The dogs 92 may be disposed within a guide 96, which enables the dogs 92 to slide radially about the axial centerline 48. In some embodiments, the guide 96 is fixedly coupled to the downhole device 12 (e.g., to the electronics housing 54), such that the guide 96, and thus the dogs 92, are blocked from rotational movement about the axial centerline 48. A cam 98 may be disposed about the guide 96. The cam 98 may rotate about the axial centerline 48, thus enabling the cam 98 to rotate relative to the dogs 92 disposed within the guide 96. As described in greater detail herein, the cam 98 may block radial movement of the dogs 92 while the dogs 92 are in the engaged position. Conversely, the cam 98 may enable radial movement of the dogs 92 such that the dogs 92 may be moved to the disengaged position.

In some embodiments, a cam gear 100 may be coupled to a portion (e.g., an inner circumference) of the cam 98. In other embodiments, the cam gear 100 may be integrated with the cam 98, such that the cam gear 100 and the cam 98 may be a single piece component. The cam gear 100 may facilitate rotational motion of the cam 98 about the axial centerline 48. For example, a motor 102 (e.g., a D.C. brushless motor) may be used to rotate the cam gear 100, and thus rotate the cam 98. The motor 102 may include a transmission shaft 104 that engages with the cam gear 100, such that rotational motion of the motor 102 induces rotational motion of the cam gear 100 and, thus, the cam 98. As described in greater detail herein, the motor 102 may be controlled by an electronics board 108, which may be communicatively coupled to the data processing system 28, or any suitable system by which the electronics board 108 may be operated.

For example, an operator (e.g., a human operator) may control the motor 102 from the surface of the wellbore 16, such that the operator may engage or disengage the dogs 92 of the motorized release device 90. Accordingly, the operator may decouple the cable 18 and the rope socket assembly 56 from the downhole device 12 (e.g., when the downhole device 12 is stuck within the wellbore 16). In certain embodiments, a processor (e.g., the processor 30) may substantially automatically determine when to move the dogs 92 between the engaged position 94 and the disengaged position. For example, the processor may monitor certain parameters of the well-logging system 10 (e.g., a torque applied by the drum 22, a tension in the cable 18) and move the dogs 92 to the disengaged position when the parameters exceed a threshold value. The processor may be located near the surface of the wellbore 16, such as the processor 30 of the data processing system 28, or may be integrated within the electronics boards 108 of the downhole device 12. In any case, movement of the dogs 92 between the engaged position 94 and disengaged position may couple or decouple, respectively, the downhole device 12 from the rope socket assembly 56.

Figure 5:
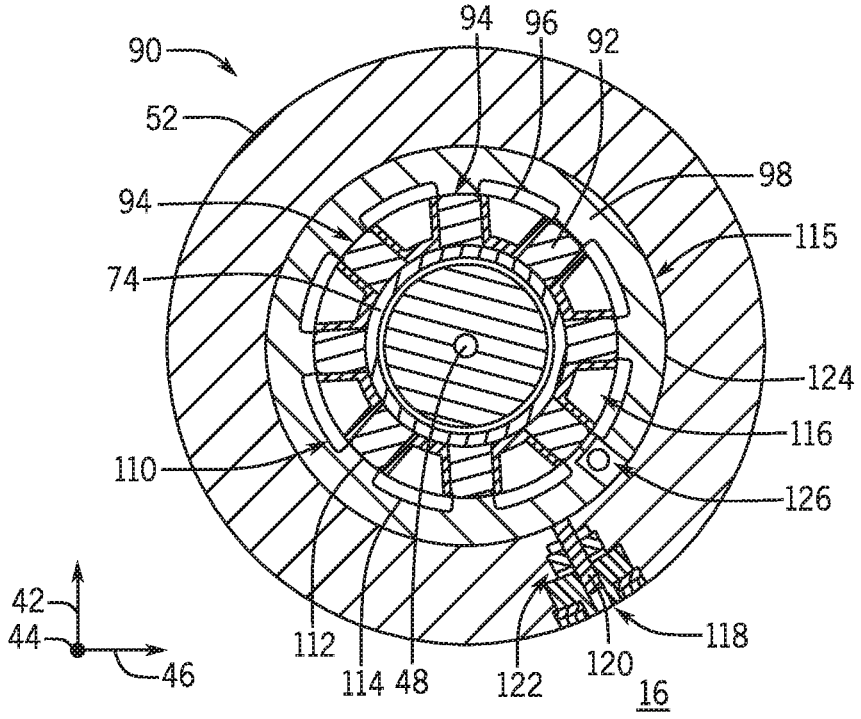
FIG. 5 is a cross-sectional view of the motorized release device of FIG. 4 showing a cam in a locked position, in accordance with an embodiment of the present disclosure.

FIG. 5 is a cross-sectional view of the motorized release device 90 that illustrates the dogs 92 in the engaged position 94, such that the strain gauge 74 of the rope socket assembly 56 is coupled to the downhole device 12. Although eight dogs 92 are shown in the illustrated embodiment, it should be noted that the motorized release device 90 may include 1, 2, 3, 4, 5, 6, 7, 8, 9, 10, or more dogs 92. The cam 98 may include a contoured profile 110 that is disposed about an inner circumference of the cam 98. The contoured profile 110 may include lobes 112 and grooves 114, which extend radially along the cam 98. In some embodiments, a quantity of the lobes 112 and a quantity of the grooves 114 of may be equal to a quantity of the dogs 92 included in the motorized release device 90.

The dogs 92 may be blocked from radial movement about the axial centerline 48 while the cam 98 is in a locked position 115. For example, the lobes 112 of the cam 98 may be radially aligned with the dogs 92 while the cam 98 is in the locked position 115, such that the dogs 92 are unable to extend radially outward. Because the guide 96 may block the dogs 92 from rotational movement (e.g., about the axial centerline 48) and vertical movement (e.g., along the vertical direction 44), the dogs 92 may remain substantially fixed while the cam 98 is in the locked position 115.

Figure 8:
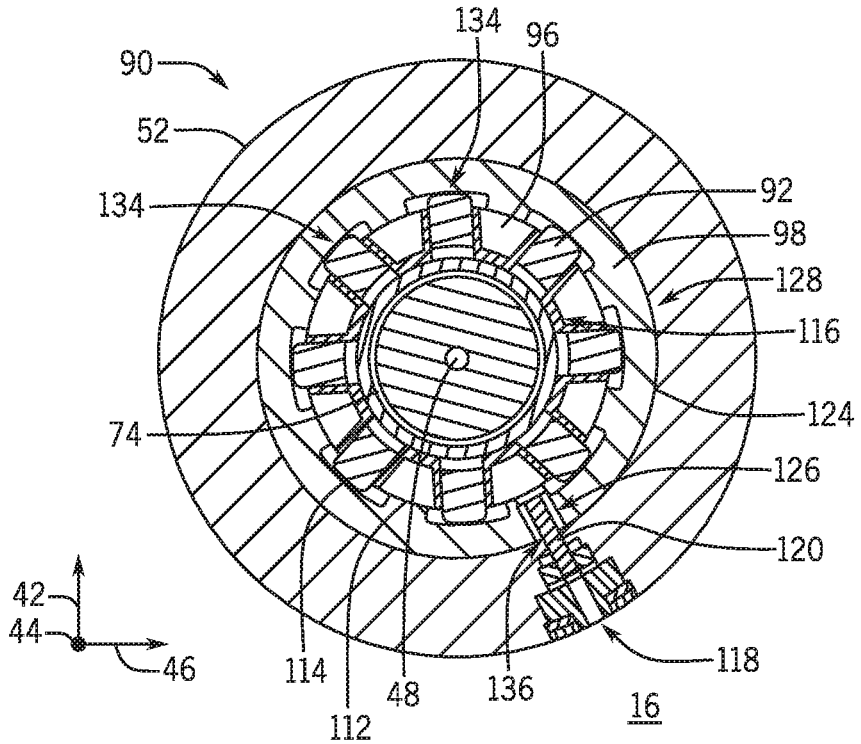
FIG. 8 is a cross-sectional view of the motorized release device of FIG. 4, showing the dogs in a disengaged position, in accordance with an embodiment of the present disclosure.

As described in greater detail herein, a pressure within the wellbore 16 may be substantially larger than a pressure within an interior region 116 of the motorized release device 90. Accordingly, a pressure differential is generated between the wellbore 16 and the interior region 116. In some embodiments, the pressure differential may block the downhole device 12 from decoupling with the rope socket assembly 56, even if the cam 98 is an unlocked position, such that the dogs 92 may disengage with the connection area 76 of the strain gauge 74. A pressure relief valve 118 may be disposed within a portion of the downhole device 12 (e.g., within the electronics housing 54) and used to neutralize the pressure differential between the interior region 116 and the wellbore 16 when decoupling the rope socket assembly 56 from the downhole device 12. For example, the pressure relief valve 118 may include a sealing pin 120 that may slide radially between an open position (as shown in FIG. 8) and a closed position 122. The sealing pin 120 may enable wellbore fluids to flow through the pressure relief valve 118 while the sealing pin 120 is in the open position. Conversely, the sealing pin 120 may prevent wellbore fluids from flowing through the pressure relief valve 118 while the sealing pin 120 is in the closed position 122.

Figure 6:
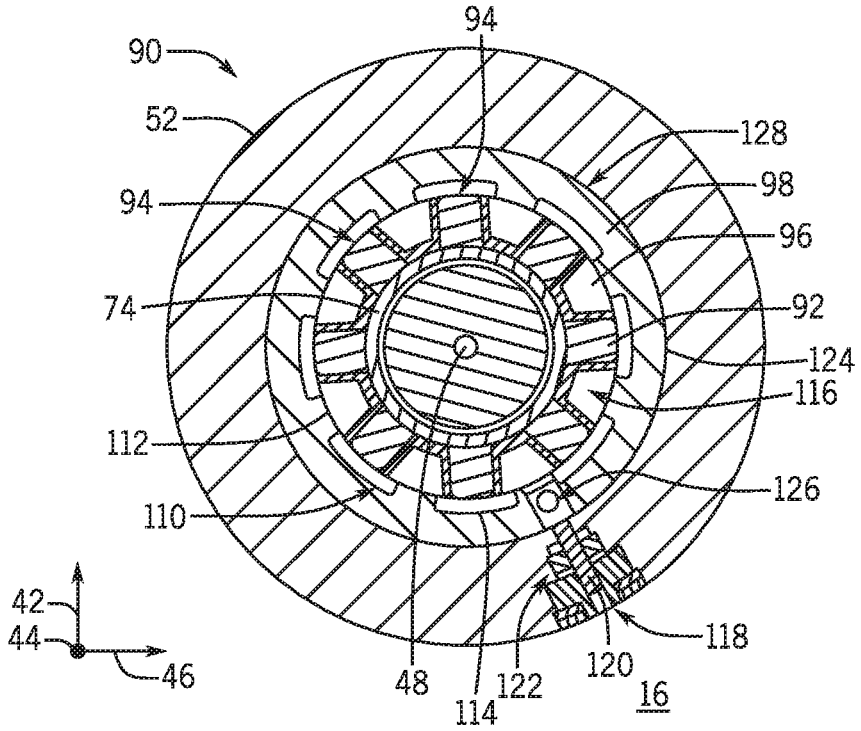
FIG. 6 is a cross-sectional view of the motorized release device of FIG. 4 showing the cam in an unlocked position, in accordance with an embodiment of the present disclosure.

In the illustrated embodiment, pressure from the wellbore fluids force the sealing pin 120 against an external circumference 124 of the cam 98, such that the sealing pin 120 remains in the closed position 122. Accordingly, wellbore fluids are blocked from entering the interior region 116 of the motorized release device 90. In some embodiments, the cam 98 may include a pressure relief passage 126, which extends between the external circumference 124 of the cam 98 and the interior region 116 of the motorized release device 90. As discussed above, the cam 98 may rotate about the axial centerline 48 via the motor 102, such that the cam 98 may move between the locked position 115 and the unlocked position (as shown in FIG. 6). In some embodiments, the pressure relief passage 126 may radially align with the sealing pin 120 when the cam 98 is rotated to the unlocked position (as shown in FIG. 8). As described in greater detail herein, pressure from the wellbore fluids may thus move the sealing pin 120 to the open position by sliding the sealing pin 120 radially inward into the pressure relief passage 126. Accordingly, wellbore fluids may flow through the pressure relief valve 118 and the pressure relief passage 126, such that the wellbore fluids may enter the interior region 116 of the motorized release device 90 and neutralize the pressure differential between the interior region 116 and the wellbore 16.

Figure 7:
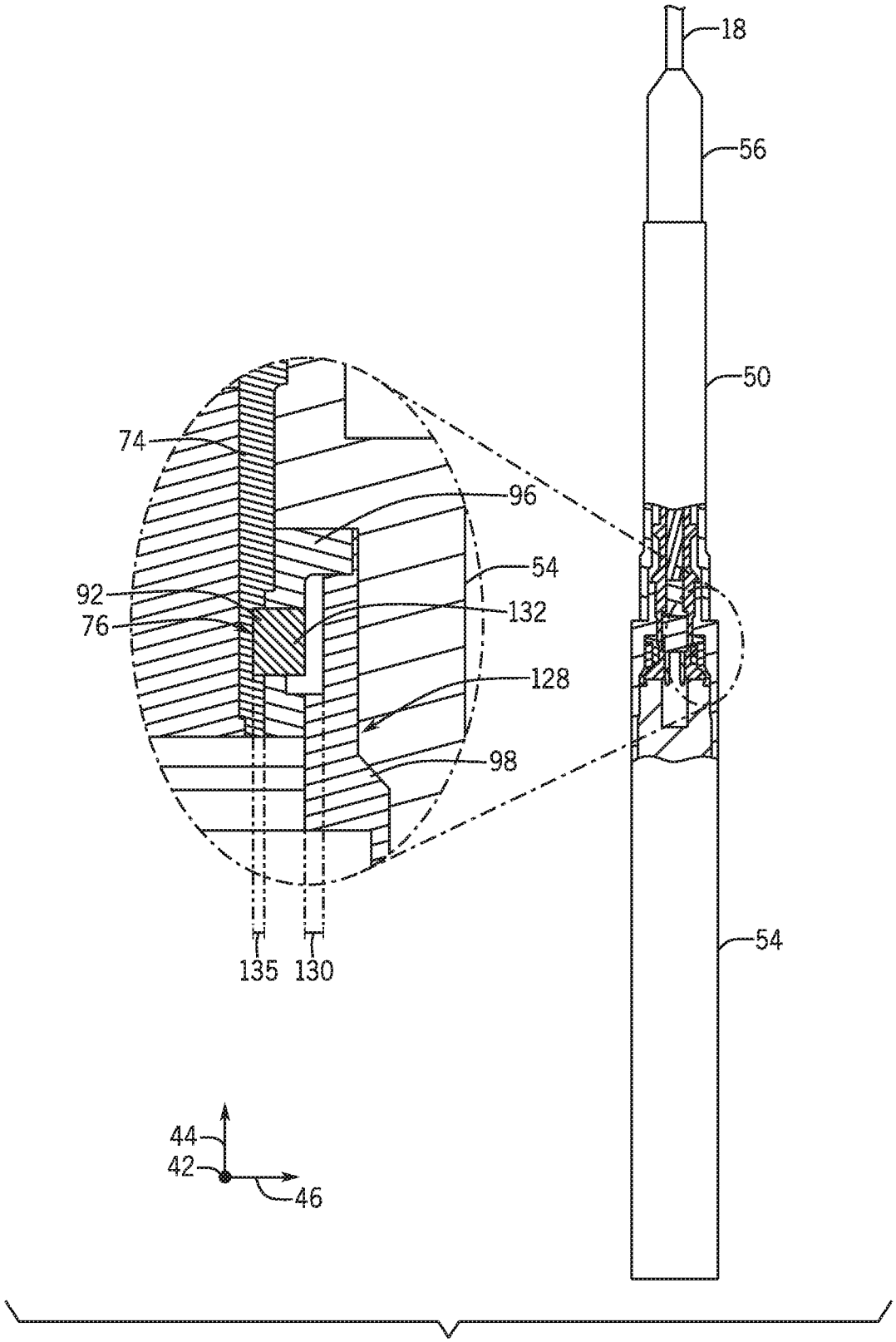
FIG. 7 is a cross-sectional view of the motorized release device of FIG. 4, showing dogs in an engaged position, in accordance with an embodiment of the present disclosure.

FIG. 6 illustrates the cam 98 in the unlocked position 128, before the sealing pin 120 has moved to the open position. When the cam 98 is moved to the unlocked position 128, the grooves 114 within the cam 98 may radially align with the dogs 92. As shown in FIG. 7, rotation of the cam 98 to the unlocked position 128 may generate a gap 130 between an outer surface 132 of the dogs 92 and the cam 98. In some embodiments, a length of the gap 130 may be substantially equal to, or greater than, a depth 135 of the connection area 76. Accordingly, the strain gauge 74 is enabled to force the dogs 92 radially outward when decoupling from the downhole device 12, such that the dogs 92 may be moved to the disengaged position.

FIG. 8 illustrates the dogs 92 in the disengaged position 134. As discussed above, the pressure relief valve 118 may neutralize the pressure differential between the interior region 116 of the motorized release device 90 and the wellbore 16 before the rope socket assembly 56 may decouple from the downhole device 12. In some embodiments, the sealing pin 120 may move to the open position 136 by extending radially into the pressure relief passage 126 of the cam 98. As such, wellbore fluids may flow into the interior region 116 of the motorized release device 90, thus neutralizing the pressure differential between the interior region 116 and the wellbore 16. Accordingly, the cable 18 may be spooled by the drum 22 enabling the rope socket assembly 56 to decouple from the downhole device 12. Specifically, the strain gauge 74 may force the dogs 92 into the grooves 114 of the cam 98, such that the dogs 92 are move to the disengaged position 134. As such, the dogs 92 may disengage with the connection area 76, enabling the strain gauge 74, and hence the rope socket assembly 56, to decouple from the downhole device 12.

Figure 9:
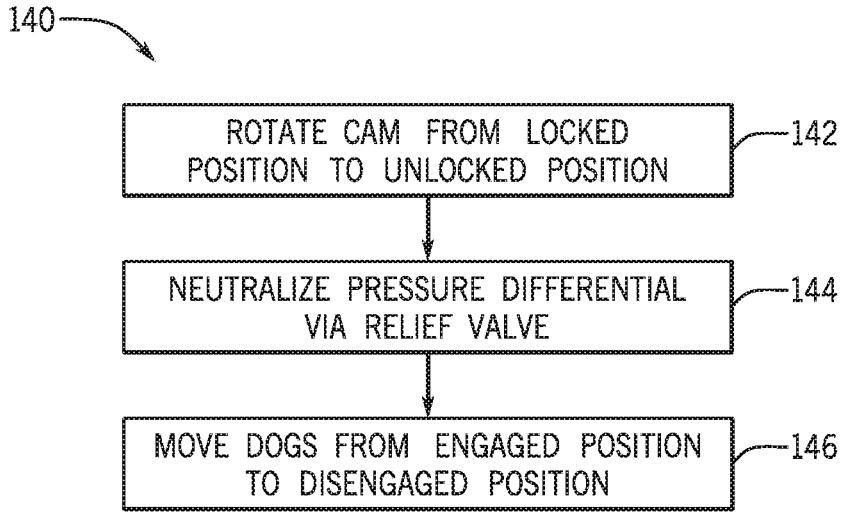
FIG. 9 is an embodiment of a method that may be used to operate the motorized release device of FIG. 4, in accordance with an embodiment of the present disclosure.

With the foregoing in mind, FIG. 9 illustrates an embodiment of a method 140 that may be used to operate the motorized release device 90. As discussed above, the motorized release device 90 may be used to decouple the downhole device 12 from the rope socket assembly 56 during certain operational conditions. In some embodiments, the motor 102 of the motorized release device 90 may be used to rotate (process block 142) the cam 98 about the axial centerline 48 from the locked position 115 to the unlocked position 128. When the cam 98 is in the unlocked position 128, the sealing pin 120 may radially align with the pressure relief passage 126 disposed within the cam 98. Wellbore fluids may push the sealing pin 120 radially inward (e.g., from the closed position 122 to the open position 136). Accordingly, wellbore fluids may enter the interior region 116 of the motorized release device 90, such that the pressure differential between the interior region 116 and the wellbore 16 is neutralized (process block 144).

When the cam 98 is moved to the unlocked position 128, the gap 130 is generated between the outer surface 132 of the dogs 92 and the cam 98. The gap 130 may enable the dogs 92 to slide radially outwards and move (process block 146) from the engaged position 94 to the disengaged position 134, such that the strain gauge 74 may decouple from the downhole device 12. Accordingly, the cable 18 may move the rope socket assembly 56 independently of the downhole device 12.

Figure 10:
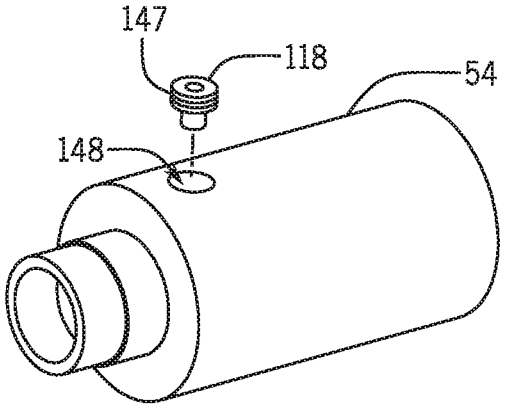
FIG. 10 is a perspective view of an embodiment of the downhole device of FIG. 2, showing a removable pressure release valve, in accordance with an embodiment of the present disclosure.

FIG. 10 is a perspective view of an embodiment of the electronics housing 54. In some embodiments, the pressure relief valve 118 may be removably coupled to electronics housing 54, such that the pressure relief valve 118 may be replaced with a different pressure relief valve and/or inspected for wear. For example, the pressure relief valve 118 may include threads 147 that are disposed about a circumference of the pressure relief valve 118. The threads 147 may be configured to engage with an aperture 148 disposed within the electronics housing 54. Accordingly, the pressure relief valve 118 may be threaded or unthreaded from the aperture 148 of the electronics housing 54. However, it should be noted that in other embodiments, the pressure relief valve 118 may be removably coupled to the electronics housing 54 via a press fit, adhesives, or the like. In any case, the pressure relief valve 118 may be removed from the electronics housing 54 as a single piece component.

Figure 11:
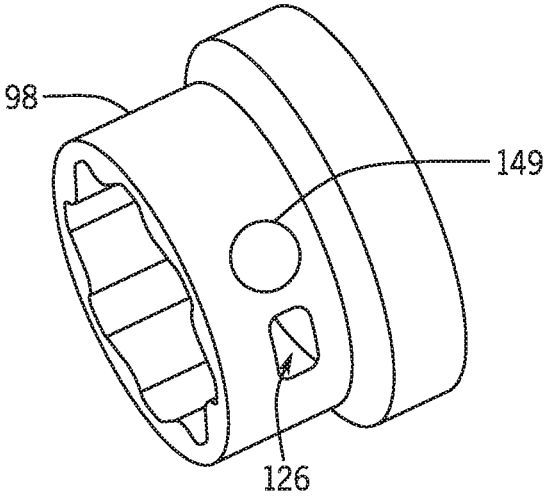
FIG. 11 is a perspective view of an embodiment of the cam of FIG. 5, showing a locking indicator, in accordance with an embodiment of the present disclosure.
Figure 12:
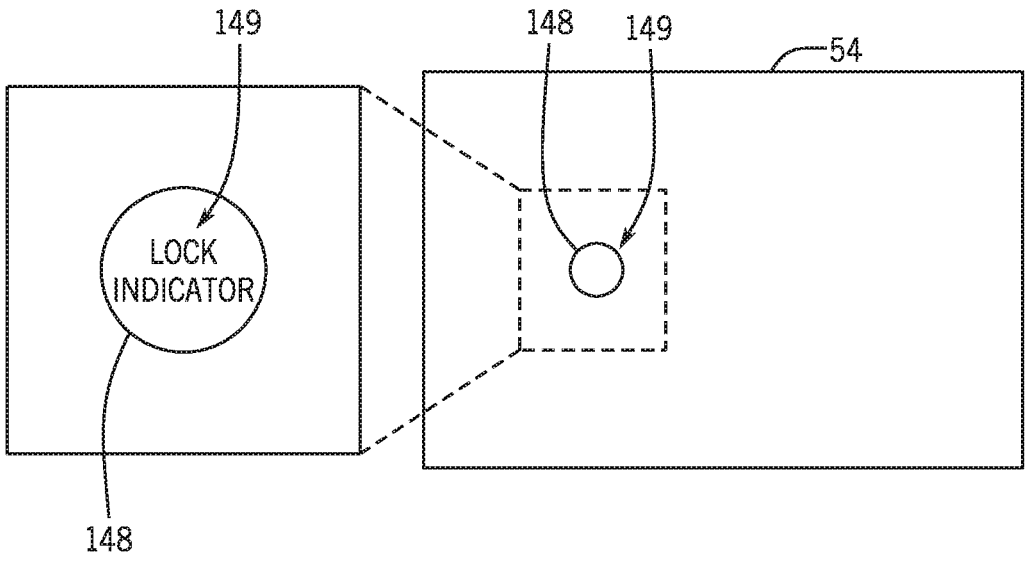
FIG. 12 is a side view of an embodiment of the downhole device of FIG. 10, in accordance with an embodiment of the present disclosure.

In some embodiments, the aperture 148 may be disposed radially adjacent to the cam 98, such that the aperture 148 extends between an outer surface of the electronics housing 54 and an outer surface of the cam 98. As such, an operator (e.g., the service technician) may visually inspect the cam 98 by viewing through the aperture 148 when the pressure relief valve 118 is removed. The cam 98 may include a locking indicator 149 that is stamped, printed, or engraved onto the outer surface of the cam 98, as shown in FIG. 11. The locking indicator 149 may include any suitable combination of symbols and/or text that may convey to the operator a position of the cam 98 (e.g., that the cam 98 is disposed in the locked position 115). For example, as shown in FIG. 12, the locking indicator 149 may align with the aperture 148 when the cam 98 is disposed in the locked position 115, such that the operator may visually verify that a position of the cam 98 is the locked position 115. In other words, the operator may view the locking indicator 149 through the aperture 148, and thus, verify that the cam 98 is disposed in the locked position 115. Similarly, the pressure relief passage 126 may align with the aperture 148 when the cam 98 is disposed in the unlocked position 128, and thus, enable the operator to determine that a position of the cam 98 is the unlocked position 128 via visual inspection through the aperture 148. Subsequent to visual inspection of a position of the cam 98 through the aperture 148, the operator may couple the pressure relief valve 118 to the electronics housing 54 via the threads 147.

Figure 13:
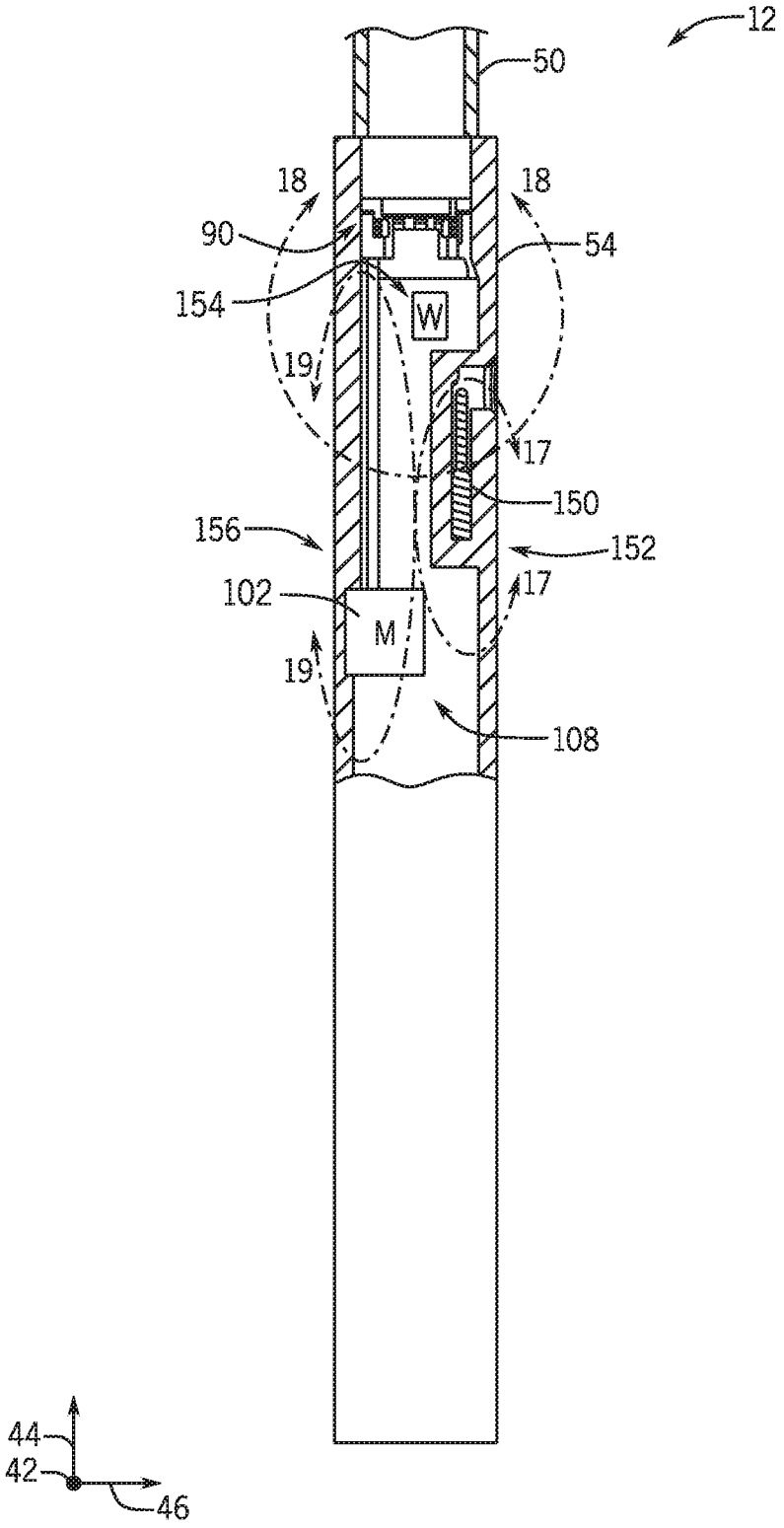
FIG. 13 is a cross-sectional view of an electronics housing that may couple to the downhole device of FIG. 2, in accordance with an embodiment of the present disclosure.

FIG. 13 is a cross-sectional view of the electronics housing 54 of the downhole device 12. The electronics housing 54 may house the electronics board 108, which may include the motor 102, sensors, control telemetry, communication devices, or any other suitable electronic components of the downhole device 12. For example, the electronics board 108 may include a resistance temperature device 150 (e.g., an RTD 150), which may collect real time temperature data of wellbore fluids (e.g., mud) within the wellbore 16, and transmit the collected data to the data processing system 28. As described in greater detail herein, the electronics board 108 may be removed from the electronics housing 54 as a single unit, such that electrical components (e.g., the motor 102, the RTD 150) of the downhole device 12 may be separated from mechanical components (e.g., the motorized release device 90) of the downhole device 12. As such, an operator may replace substantially all electrical components of the downhole device 12 in a small interval of time (e.g., less than 30 seconds) by replacing the entire electronics board 108, as a single unit, with another electronics board.

In order to facilitate the rapid removal and replacement of the electronics board 108, the electronics board 108 may engage with the electronics housing 54 at several connection points. As described in greater detail herein, the connection points may include a RTD coupling 152, a wire coupling 154, and a drive shaft coupling 156. The RTD coupling 152 may enable rapid removal and replacement of the RTD from the electronics housing 54. The wire coupling 154 may enable all electrical connections between the electronics board 108 and the electronics housing 54 to be established through a single connection point. Finally, the drive shaft coupling 156 may enable the motor 102 to couple with, or decouple from, the transmission shaft 104 used to rotate the cam 98 of the motorized release device 90.

Figure 14:
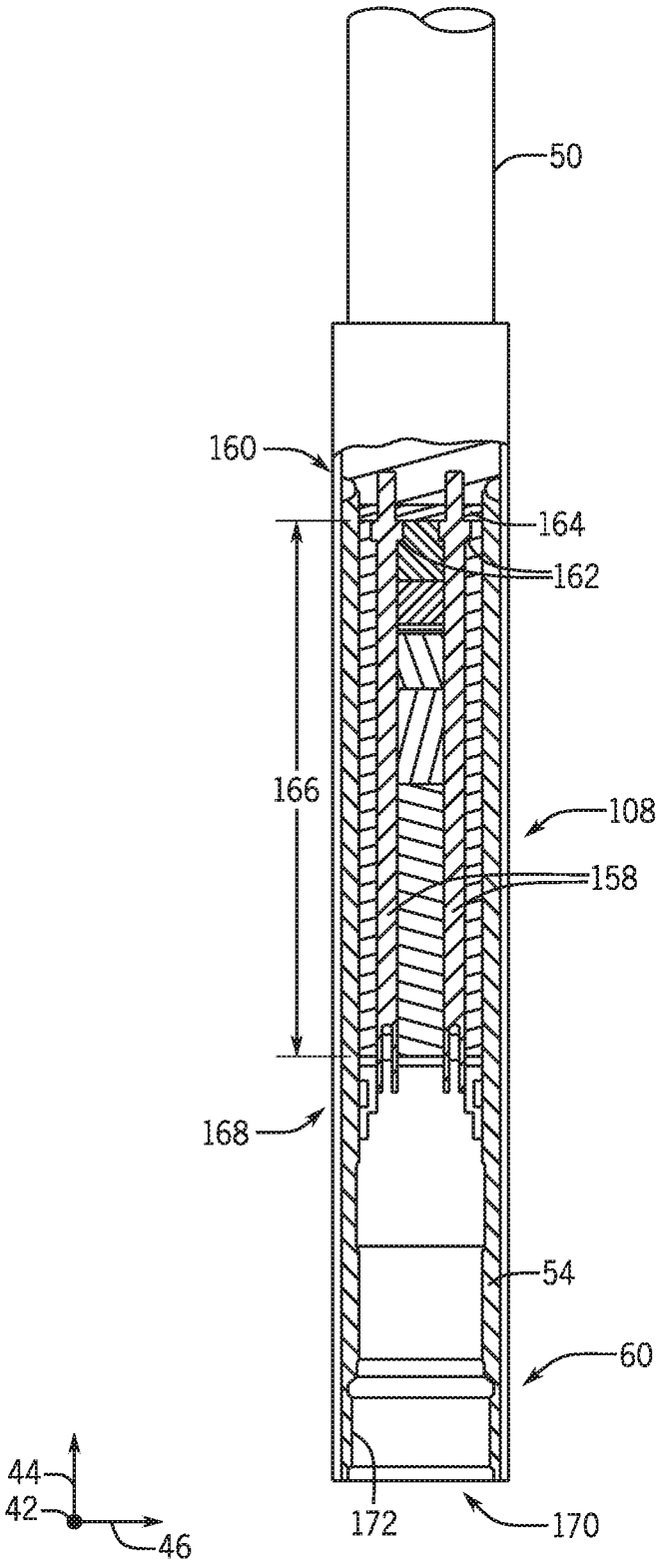
FIG. 14 is a cross-sectional view of the electronics housing of FIG. 13, showing bolts that may couple an electronics board to the electronics housing, in accordance with an embodiment of the present disclosure.

FIG. 14 illustrates retaining bolts 158 that may be used to couple the electronics board 108 to the electronics housing 54. Although two retaining bolts 158 are shown in the illustrated embodiment, the electronics board 108 may be coupled to the electronics housing 54 via 1, 2, 4, 5, or more retaining bolts 158. In some embodiments, each of the retaining bolts 158 may include a single piece component that may thread into an upper end portion 160 of the electronics housing 54. In other embodiments, the retaining bolts 158 may include multiple, individual components that may be coupled to one another and thus form the retaining bolts 158. The retaining bolts 158 may each include protrusions 162 that are configured apply a compressive force between an end plate 164 of the electronics board 108 and the electronics housing 54, such that the electronics board 108 may be coupled to the electronics housing 54. The end plate 164 may distribute the compressive force applied by the retaining bolts 158 over a larger surface area of the electronics housing 54.

Figure 15:
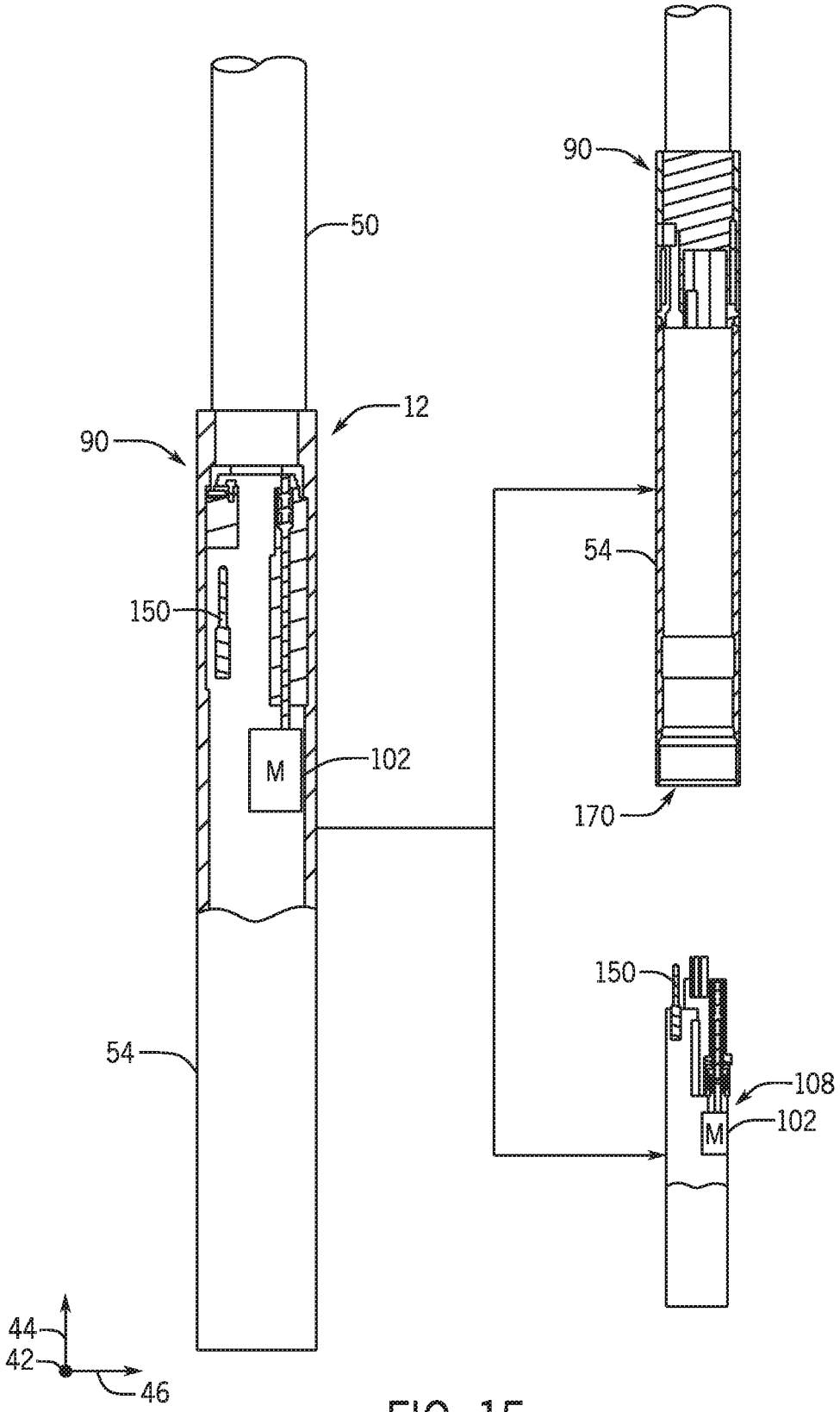
FIG. 15 is a schematic diagram of the electronics housing and the electronics board of FIG. 14, in accordance with an embodiment of the present disclosure.

In some embodiments, the retaining bolts 158 may extend along a length 166 of the electronics board 108. An operator (e.g., a service technician) may access and loosen (e.g., unthread from the upper end portion 160 of the electronics housing 54) the retaining bolts 158 near a lower end portion 168 of the electronics housing 54. For example, the operator may access the retaining bolts 158 through an opening 170 generated by a threaded coupler 172 disposed near the lower end portion 60 of the downhole device 12. In some embodiments, the retaining bolts 158 may remain coupled to the electronics board 108 when the retaining bolts 158 are unthreaded from the upper end portion 160 of the electronics housing 54. As shown in FIG. 15, the operator may thus remove the electronics board 108 and the retaining bolts 158 from the electronics housing 54 through the opening 170 after unthreading the retaining bolts 158 from the upper end portion 60 of the electronics housing 54. As such, the operator may separate the electronics board 108 from the electronics housing 54 and the motorized release device 90.

Figure 16:
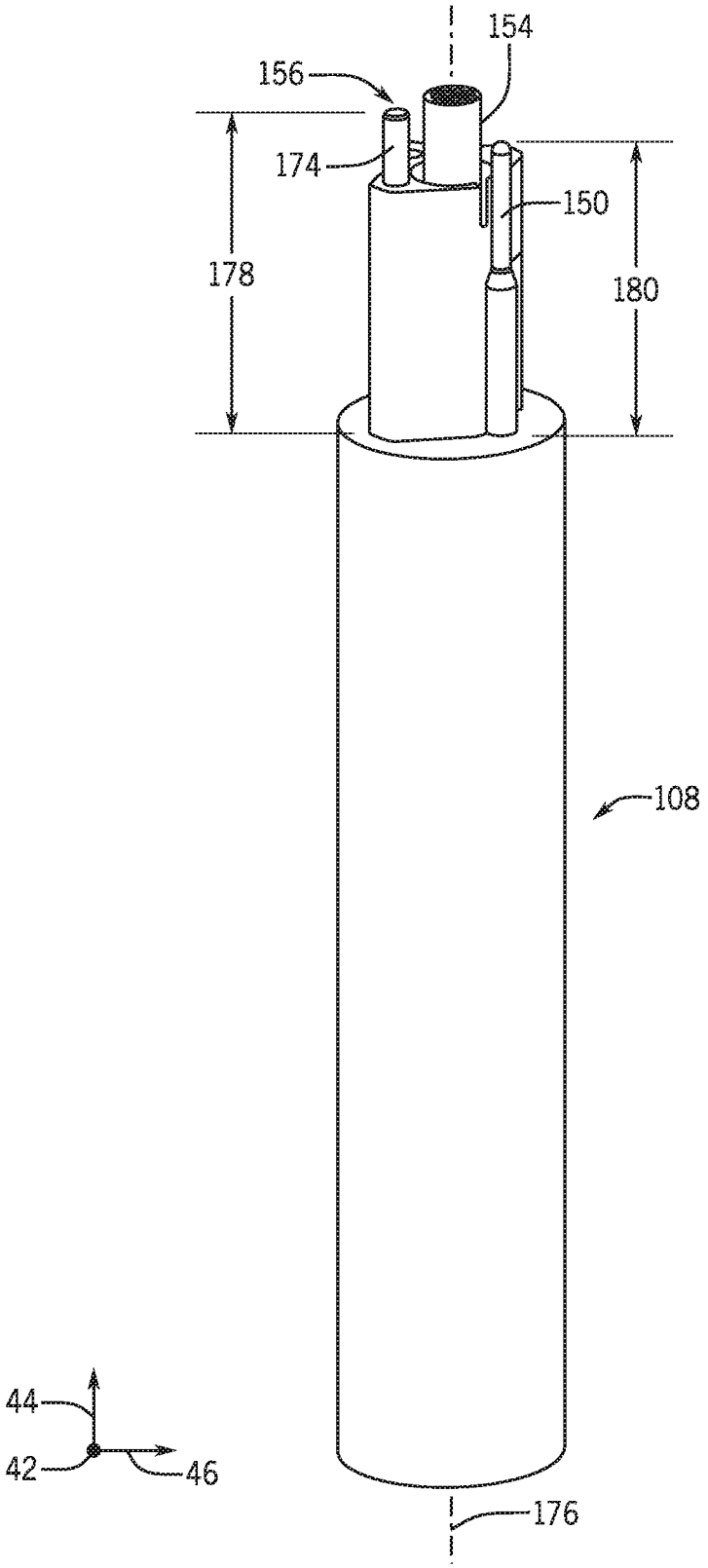
FIG. 16 is a perspective view of the electronics board of FIG. 15, in accordance with an embodiment of the present disclosure.

FIG. 16 is a perspective view of an embodiment of the electronics board 108. An alignment peg 174 may be used to facilitate aligning the electronics board 108 within the electronics housing 54 when re-inserting the electronics board 108 into the electronics housing 54. For example, the alignment peg 174 may be radially transposed with respect to an axial centerline 176 of the electronics board 108. Accordingly, the alignment peg 174 may only enable the electronics board 108 to fully slide into the electronics housing 54 when the alignment peg 174 is concentric to an alignment hole within the electronics housing 54. As such, the alignment peg 174 may ensure that the RTD coupling 152, the wire coupling 154, and the drive shaft coupling 156 of the electronics board 108 are properly aligned with the electronics housing 54. In some embodiments, an extension height 178 of the alignment peg 174 may be longer than an extension height 180 of the RTD 150. The alignment peg 174 may thus prevent the RTD 150 from experiencing an undesirable compressive force (e.g., along the vertical direction 44) if electronics boards 108 is inserted into the electronics housing 54 misaligned.

Figure 17:
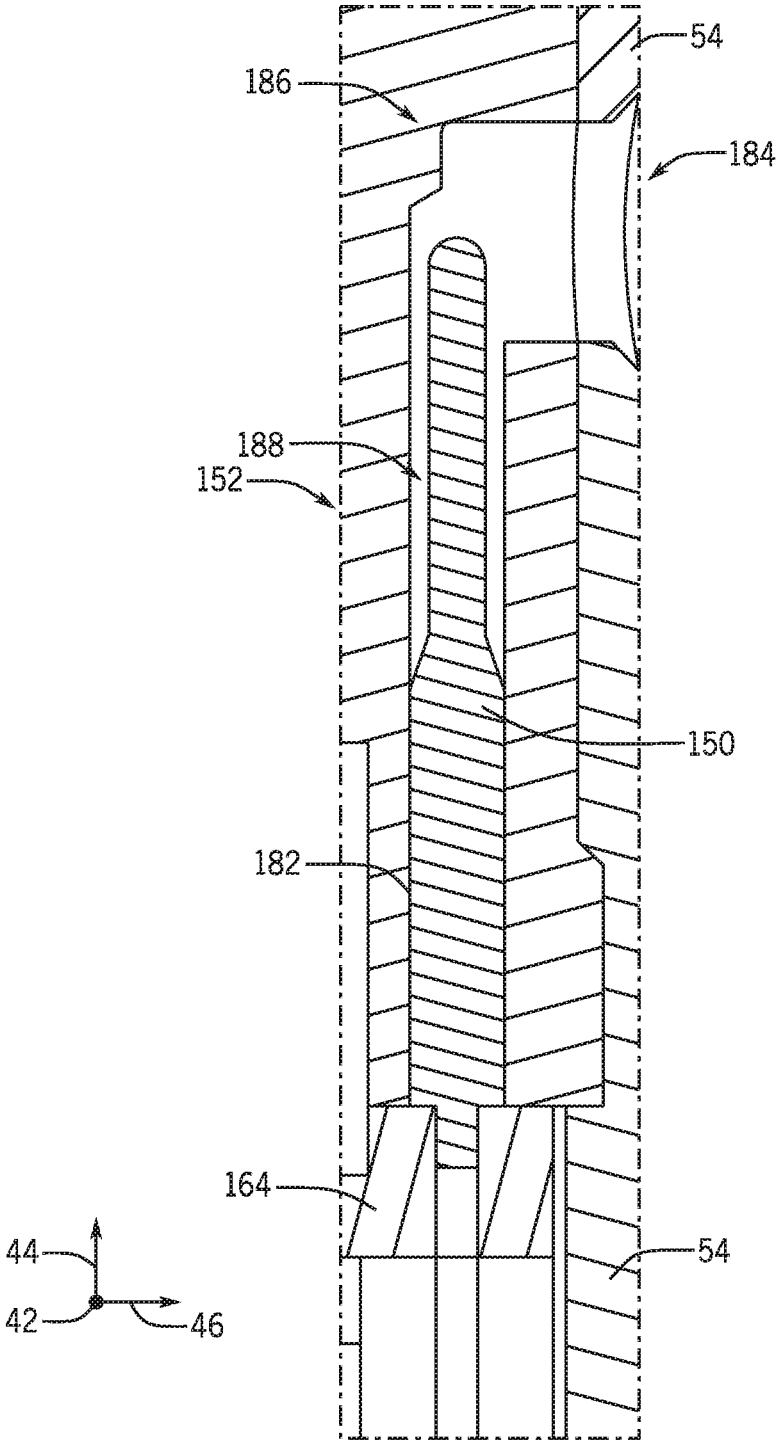
FIG. 17 is a close up cross-sectional view of the electronics housing of FIG. 13 taken along line 17-17, in accordance with an embodiment of the present disclosure.

FIG. 17 is a close-up cross-sectional view of line 17-17 in FIG. 13, illustrating the RTD coupling 152. As discussed above, the alignment peg 174 may ensure that the electronics board 108 engages electronics housing 54 at a proper orientation. Accordingly, the RTD 150 may engage with the RTD coupling 152 when the electronics board 108 is inserted in to the electronics housing 54. In some embodiments, the RTD 150 may be disposed within an elongated channel 182 of the RTD coupling 152. As discussed above, the RTD 150 may be used to measure the temperature of wellbore fluids (e.g., mud) within the wellbore 16. In some embodiments, an opening 184 within the electronics housing 54 may enable to RTD 150 to fluidly communicate with the wellbore fluids. As such, the wellbore fluids may flow into an upper portion 186 of the RTD coupling 152 and may fill a gap 188 between the RTD 150 and the elongated channel 182.

In some embodiments, seals may be disposed between the RTD 150 and the elongated channel 182, such that the wellbore fluids may be blocked from flowing into other regions of the electronics housing 54. In other embodiments, the RTD 150 may be sealingly disposed (e.g., via a compression fit) within the elongated channel 182, such that the seals may be omitted. Pressure from the wellbore fluids may apply a compressive force (e.g., along the vertical direction 44) to the RTD 150, which may transfer the compressive force to the end plate 164 of the electronics housing 54. The end plate 164 may thus distribute the compressive force across the electronics housing 54. The end plate 164 may be of any suitable material, such as steel, which enables the end plate 164 to transfer the compressive force from the RTD 150 without deforming.

Figure 18:
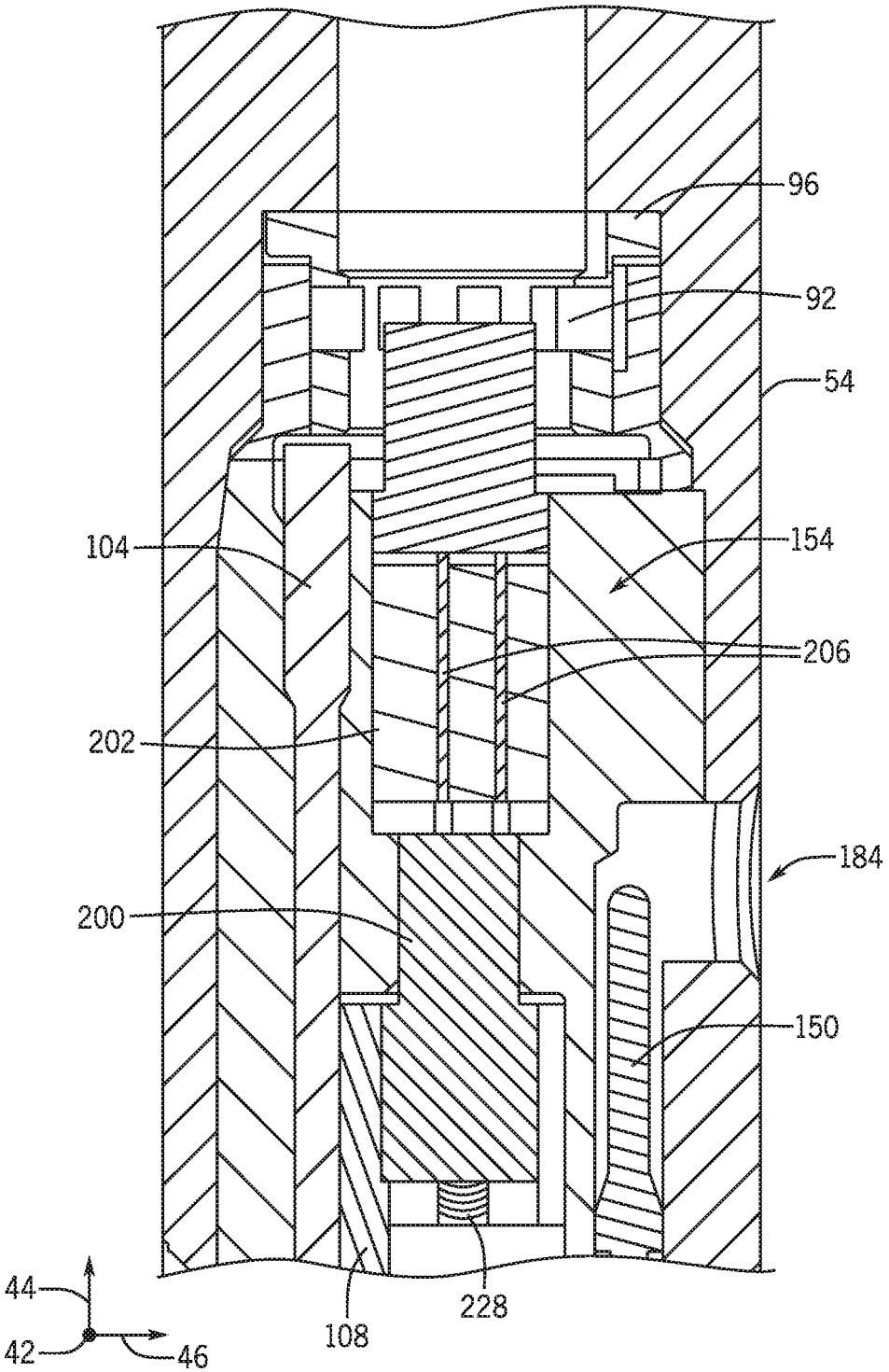
FIG. 18 is a close up cross-sectional view of the electronics housing of FIG. 13 taken along line 18-18, in accordance with an embodiment of the present disclosure.

FIG. 18 is a close up cross-sectional view of line 18-18 in FIG. 13, illustrating the wire coupling 154 disposed within the downhole device 12. The wire coupling 154 may enable the electronics board 108 to electrically couple to the downhole device 12 via a single connection. For example, the wire coupling 154 may include a contact block 200 that removably couples to a bulkhead 202. In some embodiments, the contact block 200 and the bulkhead 202 may each include twelve pin connectors 206 that may engage with one another when the contact block 200 couples to the bulkhead 202. However, it should be noted that the contact block 200 and the bulkhead 202 may include fewer or more than twelve pin connectors 206. For example, the contact block 200 and bulkhead 202 may each include 1, 2, 3, 4, 5, 10, 15, 20 or more pin connectors 206.

In some embodiments, the contact block 200 may be coupled to the electronics board 208 via a spring 228, while the bulkhead 202 is fixedly coupled to a portion of the downhole device 12, such as the electronics housing 54. The spring 228 may be compressed when the electronics board 108 is inserted into the electronics housing 54 and the contact block 200 engages with the bulkhead 202. Accordingly, the spring 228 may apply a compressive force between the contact block 200 and the bulkhead 202 while the electronics board 108 is disposed within the electronics housing 54, which may ensure that the electrical connection between the contact block 200 and the bulkhead 202 is maintained.

Figure 19:
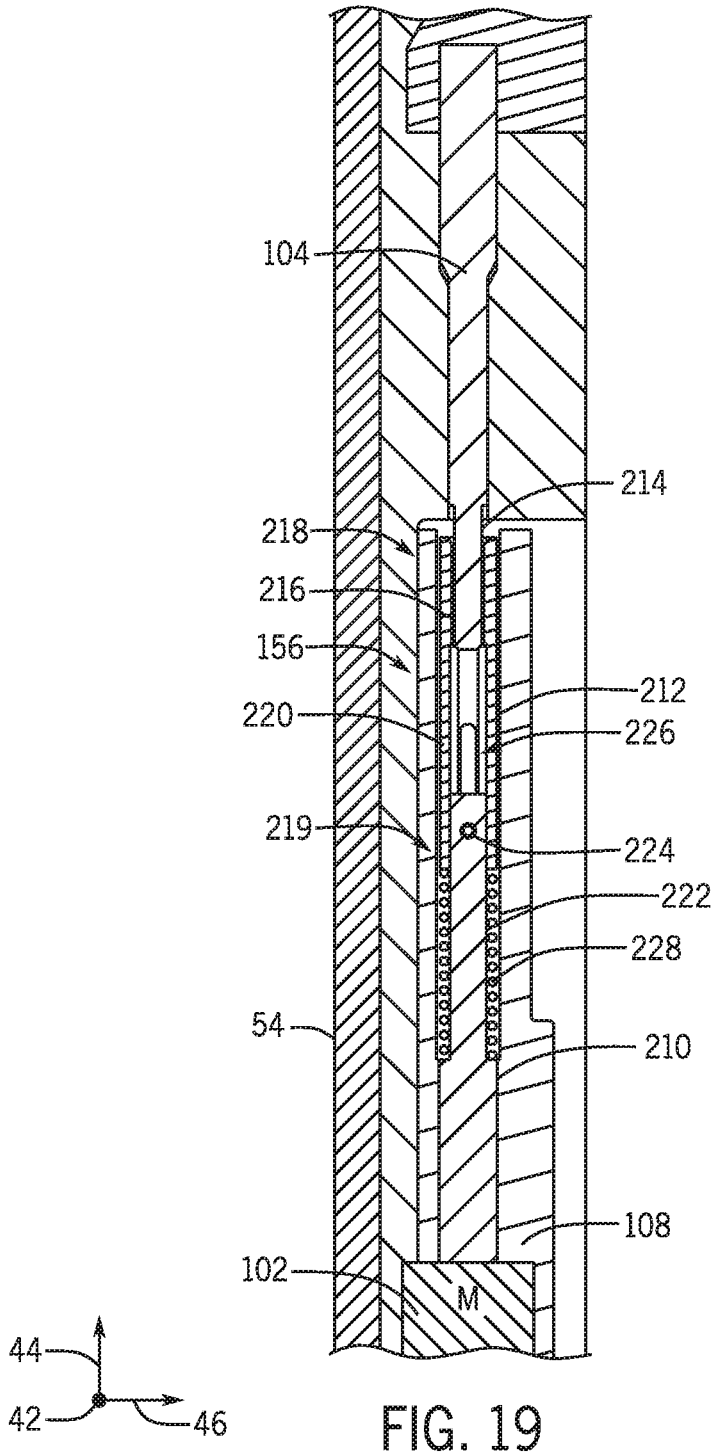
FIG. 19 is a close up cross-sectional view of the electronics housing of FIG. 13 taken along line 19-19, in accordance with an embodiment of the present disclosure.

FIG. 19 is a close-up cross-sectional view of line 19-19 in FIG. 13, illustrating the drive shaft coupling 156. As discussed above, the motor 102 may be coupled to the electronics board 108 and the transmission shaft 104 may be rotatably coupled a portion of the downhole device 12, such as the electronics housing 54. As such, the drive shaft coupling 156 may enable the motor 102 to couple with the transmission shaft 104 when the electronics board 108 is inserted into the electronics housing 54. Similarly, the drive shaft coupling 156 may enable the motor 102 to decouple from the transmission shaft 104 when the electronics board 108 is removed from the electronics housing 54.

For example, the drive shaft coupling 156 may include a lower coupling 210 and an upper coupling 212 that may transmit rotational motion (e.g., about the vertical direction 44) between the motor 102 and the transmission shaft 104. As described in greater detail herein, the transmission shaft 104 may include a hexagonal cross-section 214 (e.g., an external hex 214) that engages with an internal profile 216 (e.g., an internal hex 216) disposed within a first end portion 218 of the upper coupling 212. In certain embodiments, the external hex 214 may be misaligned relative to the internal hex 216 when the electronics board 108 is inserted into the electronics housing 54. As described in greater detail herein, the drive shaft coupling 156 may enable insertion of the electronics board 108 into the electronics housing 54 even if the external hex 214 and the internal hex 216 are misaligned. Furthermore, the drive shaft coupling 156 may enable the external hex 214 and the internal hex 216 to automatically align and engage with one another when the motor 102 rotates, such that the motor 102 may transmit rotational motion to the transmission shaft 104. It should be noted that the external hex 214 and the internal hex 216 are not limited to hexagonal shapes, but can be any suitable cross section such as triangular, square, circular, or oval.

A second end portion 219 of the upper coupling 212 may include an internal profile 220 that engages with an external profile 222 of the lower coupling 210. The lower coupling 210 may couple to the upper coupling 212 via a pin 224, which is disposed within a groove 226 of the upper coupling 212. The pin 224 and groove 226 may enable the upper coupling 212 to slide axially (e.g., along the vertical direction 44) relative to the lower coupling 210, while enabling the lower coupling 210 to transmit rotational motion (e.g., about the vertical direction 44) to the upper coupling 212. A spring 228 may apply a force to the upper coupling 212, such that the upper coupling 212 is in an extended position (e.g., in direction 44). The pin 224 and groove 226 may block the spring 228 from sliding the upper coupling 212 off the lower coupling 210. In some embodiments, the spring 228 may be replaced with any suitable actuator that may apply a compressive force between the upper coupling 212 and the lower coupling 210. For example, a hydraulic actuator, a pneumatic actuator, or the like may be used in addition to, or in lieu of, the spring 228. The lower coupling 210 may fixedly couple to an output shaft of the motor 102, such that the motor 102 may rotate the lower coupling 210.

As discussed above, in certain embodiments, the external hex 214 of the transmission shaft 104 may be misaligned with the internal hex 216 of the upper coupling 212 when the electronics board 108 is inserted into the electronics housing 54. In such an embodiment, the upper coupling 212 may slide axially (e.g., along the vertical axis or direction 44) over the lower coupling 210, such that the electronics board 108 may be fully seated within the electronics housing 54. Accordingly, the spring 228 between the upper coupling 212 and the lower coupling 210 may be compressed axially. When the motor 102 is turned on electronically, the motor 102 may rotate the drive shaft coupling 156, such that the external hex 214 of the transmission shaft 104 and the internal hex 216 of the upper coupling 212 align. The compressive force generated by the spring 228 may slide the upper coupling 212 over the transmission shaft 104, such that the external hex 214 and the internal hex 216 may fully engage. The motor 102 may thus transmit rotational motion to the transmission shaft 104 through the drive shaft coupling 156.

Figure 20:
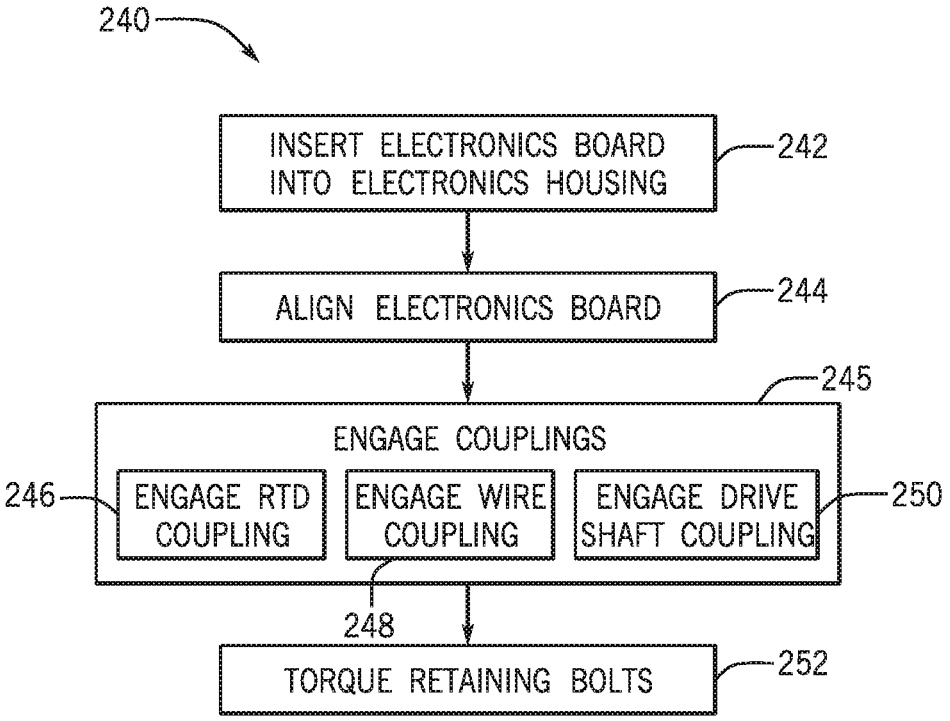
FIG. 20 is an embodiment of a method of coupling the electronics board to the electronics housing of FIG. 15, in accordance with an embodiment of the present disclosure.

With the forgoing in mind, FIG. 20 illustrates an embodiment of a method 240 that may be used to couple the electronics board 108 to the electronics housing 54 of the downhole device 12. The electronics board 108 may be inserted (process block 242) into the electronics housing 54 via the opening 170 disposed near the lower end portion 60 of the downhole device 12. An operator (e.g., the service technician) may align (process block 244) the electronics board 108 within the electronics housing 54. For example, the operator may ensure that the alignment peg 174 of the electronics board 108 is concentric with the alignment hole disposed within the electronics housing 54. In some embodiments, couplings between the electronics housing 54 and the electronics board 108 may engage (process block 245) subsequently.

For example, the RTD 150 may engage (process block 246) with the RTD coupling 152, such that RTD 150 is sealingly disposed within the elongated channel 182 of the electronics housing 54. The wire coupling 154 may engage (process block 248) the contact block 200 of the electronics board 108 with the bulkhead 202 of the electronics housing 54, such that an electrical connection is established between the pin connectors 206. The spring 228 may apply a compressive force between the contact block 200 and the bulkhead 202, such that the pin connectors 206 maintain engagement. The drive shaft coupling 156 may engage (process block 250) the output shaft of the motor 102 with the transmission shaft 104 of the of the motorized release device 90. As discussed above, the upper coupling 212 may slide over the lower coupling 210 if the external hex 214 of the transmission shaft 104 is misaligned with the internal hex 216 of the upper coupling 212. Accordingly, the drive shaft coupling 156 may enable insertion of the electronics board 108 within the electronics housing 54 even if the transmission shaft 104 and the upper coupling are misaligned. When the motor 102 rotates, the internal hex 216 of the upper coupling 212 may align with the external hex 214 of the transmission shaft 104, such that the spring 228 may slide the upper coupling 212 over the transmission shaft 104. The operator may torque (process block 252) the retaining bolts 158, such that the electronics board 108 is fixedly coupled to the electronics housing 54.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A motorized release device for downhole operation in a wellbore, comprising:

a guide disposed within a downhole device;

one or more dogs disposed within the guide, wherein the one or more dogs are configured to move radially within the guide relative to a central axis of the motorized release device between an engaged position and a disengaged position;

a cam rotatable about the central axis, wherein the cam is configured to move between a locked position and an unlocked position, wherein the cam blocks the one or more dogs from moving to the disengaged position while the cam is in the locked position; and an electronics board, wherein the electronics board is coupled to a motor that is configured to rotate the cam between the locked position and the unlocked position.

2. The motorized release device of claim 1, wherein the downhole device is coupled to a cable when the one or more dogs are in the engaged position, and wherein the one or more dogs enable the downhole device to decouple from the cable when the one or more dogs are in the disengaged position.

3. The motorized release device of claim 1, wherein the cam comprises a profile disposed about an inner circumference of the cam, wherein the profile comprises radially extending lobes and radially extending grooves.

4. The motorized release device of claim 3, wherein the radially extending lobes align with an outer face of the one or more dogs when the cam is in the locked position, such that the one or more dogs are blocked from radial movement when the cam is in the locked position, and wherein the radially extending grooves align with the outer face of the one or more dogs when the cam is in the unlocked position, such the one or more dogs are enabled to move radially when the cam is in the unlocked position.

5. The motorized release device of claim 1, wherein the cam is rotatably coupled to a transmission shaft, and wherein the motor is configured to rotate the transmission shaft.

6. The motorized release device of claim 5, wherein the motor is coupled to the transmission shaft via a drive shaft coupling, wherein the drive shaft coupling comprises an upper coupling and a lower coupling, and wherein the upper coupling is configured to engage with the transmission shaft when an external profile of the transmission shaft is aligned with an internal profile of the upper coupling.

7. The motorized release device of claim 6, wherein the upper coupling is configured to slide over the lower coupling when the external profile of the transmission shaft is misaligned with the internal profile of the upper coupling.

8. The motorized release device of claim 1, wherein the downhole device further comprises:

a pressure relief valve disposed within an aperture of the downhole device;

a sealing pin disposed within the pressure relief valve, wherein the sealing pin is configured to slide radially between an open position and a closed position; and a pressure relief passage disposed within the cam, wherein the pressure relief passage extends radially through the cam, and wherein the pressure relief passage and the sealing pin are misaligned radially when the cam is in the locked position, such that the sealing pin is blocked from moving to the open position.

9. The motorized release device of claim 8, wherein the pressure relief passage and the sealing pin are aligned radially when the cam is in the unlocked position such that the sealing pin may move to the open position.

10. The motorized release device of claim 8, wherein a locking indicator is disposed on the cam and configured to radially align with the aperture when the cam is in the locked position.

11. The motorized release device of claim 1, wherein the electronics board is removably coupled to the downhole device via retaining bolts, wherein the retaining bolts extend along a length of the electronics board.

12. A method, comprising:

rotating a cam of a motorized release device via a motor, wherein the motorized release device is disposed within a housing of a downhole device, and wherein the cam is configured to rotate between a locked position and an unlocked position;

neutralizing a pressure differential between an interior region of the motorized release device and an ambient environment via a pressure relief valve, wherein the pressure relief valve comprises a sealing pin that is configured to move between an open position and a closed position, wherein the sealing pin enables a fluid to flow through the pressure relief valve when the sealing pin is in the open position, and wherein the sealing pin blocks the fluid from flowing through the pressure relief valve when the sealing pin is in the closed position; and moving one or more dogs via a rope socket assembly, wherein the one or more dogs are configured to move between an engaged position and a disengaged position, wherein the one or more dogs couple the rope socket assembly to the downhole device when the one or more dogs are in the engaged position, and wherein the rope socket assembly is enabled to decouple from the downhole device when the one or more dogs are in the disengaged position.

13. The method of claim 12, wherein the one or more dogs are disposed in the engaged position when the cam is disposed in the locked position, and wherein the one or more dogs are blocked from moving toward the disengaged position when the cam is in the locked position.

14. The method of claim 13, wherein the one or more dogs are configured to move radially into a groove within the cam when the cam is in the unlocked position, such that the one or more dogs are enabled to move to the disengaged position when the rope socket assembly is moved axially relative to the downhole device.

15. The method of claim 12, wherein the cam rotates about a central axis of the motorized release device when the cam moves between the locked position and the unlocked position, and wherein the one or more dogs move radially about the central axis when the one or more dogs transition between the engaged position and the disengaged position.

16. A housing of a downhole motorized release device, comprising:

a cam disposed concentrically about an axial centerline of the housing, wherein the cam is configured to rotate about the axial centerline and move between a locked position and an unlocked position, wherein a transmission shaft is rotatably coupled to the cam, such that rotation of the transmission shaft moves the cam between the locked position and the unlocked position;

one or more dogs disposed within a guide of the housing, wherein the one or more dogs are configured to move radially relative to the axial centerline between an engaged position and a disengaged position, wherein the one or more dogs are disposed in the engaged position when the cam is in the locked position; and an electronics board disposed within the housing, wherein the electronics board comprises a plurality of couplings that enable the electronics board to be removably coupled to the housing, wherein the plurality of couplings comprise at least one of:

a resistance temperature detector coupling, wherein the resistance temperature detector coupling is configured to fluidly couple a resistance temperature detector to an ambient environment surrounding the downhole device;

a wire coupling, wherein the wire coupling is configured to couple one or more electrical connections between the electronics board and the housing; and and a drive shaft coupling, wherein the drive shaft coupling is configured to couple the transmission shaft to a motor disposed on the electronics board.

17. The housing of claim 16, wherein a pressure relief valve is removably coupled to an aperture disposed within the housing, wherein a locking indicator is disposed on the cam, and wherein the locking indicator aligns with the aperture when the cam is disposed in the locked position.

18. The housing of claim 16, wherein the resistance temperature detector coupling comprises an elongated channel disposed within the housing, wherein the resistance temperature detector is sealingly disposed within the elongated channel, such that the resistance temperature detector coupling blocks fluid from entering the housing from the ambient environment.

19. The housing of claim 16, wherein the wire coupling comprises a bulkhead and a contact block, wherein the bulkhead is coupled to the housing and the contact block is coupled to the electronics board, wherein the bulkhead is configured to engage with the contact block when the electronics board is inserted into the housing, and wherein the bulkhead and the contact block establish all electrical connections between the housing and the electronics board.

20. The housing of claim 16, wherein the drive shaft coupling comprises an upper coupling and a lower coupling, wherein the lower coupling is fixedly coupled to an output shaft of the motor, wherein the upper coupling comprises an internal profile that is configured to engage with an external profile of the transmission shaft when the internal profile and the external profile are aligned, and wherein the upper coupling is configured to slide over the lower coupling when the internal profile and the external profile are misaligned.

* * * * *